United States Patent [19]

Akashi et al.

[11] 4,234,679

[45] Nov. 18, 1980

[54] DRY IMAGE FORMING MATERIALS

[75] Inventors: Kageyasu Akashi; Yoshio Hayashi; Tatsumi Arakawa; Takeo Kimura; Hidehiko Kobayashi, all of Fuji, Japan

[73] Assignee: Asahi Kasei Kogyo Kabushiki Kaisha, Osaka, Japan

[21] Appl. No.: 950,772

[22] Filed: Oct. 12, 1978

[30] Foreign Application Priority Data

Oct. 17, 1977 [JP] Japan ..... 52-123575

[51] Int. Cl.[2] ..... G03C 1/02

[52] U.S. Cl. ..... 430/619; 430/620; 430/607

[58] Field of Search ..... 94/114.1, 109; 430/619, 430/620, 607

[56] References Cited

U.S. PATENT DOCUMENTS

| | | | |
|---|---|---|---|
| 3,707,377 | 12/1972 | Tiers et al. | 96/109 |
| 3,874,946 | 4/1975 | Costa et al. | 96/114.1 |
| 3,877,940 | 4/1975 | Ericson | 96/109 |
| 3,955,982 | 5/1976 | Van Allan et al. | 96/114.1 |

FOREIGN PATENT DOCUMENTS

| | | | |
|---|---|---|---|
| 51-121332 | 10/1976 | Japan | 96/114.1 |

*Primary Examiner*—Won H. Louie, Jr.

*Attorney, Agent, or Firm*—Sprung, Felfe, Horn, Lynch & Kramer

[57] ABSTRACT

A dry image forming material comprising:

(a) an organic silver salt oxidizing agent;

(b) a photosensitive silver compound or a component capable of forming a photosensitive silver compound by the reaction with the organic silver salt oxidizing agent (a);

(c) a reducing agent for silver ion; and (d) at least one compound selected from the group consisting of $\alpha,\alpha,\alpha',\alpha'$-o-tetrabromoxylene, $\alpha,\alpha,\alpha'$-,$\alpha'$-m-tetrabromoxylene, $\alpha,\alpha,\alpha',\alpha'$-p-tetrabromoxylene, 1,2-diiodoethane and tribromoacetic acid.

6 Claims, No Drawings

DRY IMAGE FORMING MATERIALS

BACKGROUND OF THE INVENTION

1. Field of the Invention

This invention relates to a dry image forming material. More particularly, it relates to a dry image forming material having good image stability.

2. Description of the Prior Art

Conventional image forming materials using a silver salt need a very complicated wet process of forming image thereon. In order to simplify the image forming process, there have been proposed photosensitive materials comprising an organic silver salt oxidizing agent, a reducing agent for silver ion and a small amount of a silver halide on which images can be formed only by dry processing. However, the images obtained by such dry processes cannot be stored for a long period of time, undesirable darkening of the background of images gradually occurs to lose the contrast. In order to avoid this disadvantage, there have been made many attempts. For example, U.S. Pat. Nos. 3,707,377 and 3,874,946 describe the use of 1,2,3,4-tetrabromobutane, tribromoquinaldine and 2-tribromomethylsulfonyl benztriazole as a background-darkening preventive agent for dry processing photosensitive materials. However, the background-darkening preventive effect of these compound is still insufficient. Furthermore, many of these compounds either reduce the stability of the photosensitive materials or discolor the background of images to yellow, and the stability of these compounds is too low to provide good image stability with the image forming materials.

SUMMARY OF THE INVENTION

According to this invention there is provided a dry image forming material comprising:

(a) an organic silver salt oxidizing agent;

(b) a photosensitive silver compound or component capable of forming a photosensitive silver compound by the reaction with the organic silver salt oxidizing agent (a);

(c) a reducing agent for silver ion; and (d) at least one compound selected from the group consisting of $\alpha$,60 ,$\alpha'$,$\alpha'$-o-tetrabromoxylene, $\alpha,\alpha,\alpha',\alpha'$-m-tetrabromoxylene, $\alpha,\alpha,\alpha',\alpha'$-p-tetrabromoxylene, 1,2-diiodoethane and tribromoacetic acid.

Thus, by using the above-described component (d) the dry image forming materials of this invention can form images thereon where undesirable darkening of the background of images can be prevented without reducing the sensitivity and the storage stability of the dry image forming materials.

DETAILED DESCRIPTION OF THE INVENTION

The organic silver salt oxidizing agents which can be employed as component (a) in this invention include silver salts of long chain aliphatic carboxylic acids having 12 to 24 carbon atoms such as silver laurate, silver myristate, silver palmitate, silver stearate, silver arachidate and silver behenate; silver salts of organic compounds having an imino group such as benztriazole silver salt, benzimidazole silver salt, carbazole silver salt and phthalazinone silver salt; silver salts of sulfur containing compounds such as S-alkylthioglycollates; silver salts of aromatic carboxylic acids such as silver benzoate and silver phthalate; silver salt of sulfinic acids such as silver o-toluenesulfinate; silver salts of phosphoric acids such as silver phenylphosphate; silver barbiturate; silver saccharate; silver salt of salicylaldoxime; and any mixtures thereof. Of these compounds, silver salts of long chain aliphatic carboxylic acids having 12 to 24 carbon atoms are preferred.

The amount of the organic silver salt oxidizing agent which can be employed in this invention typically ranges from about 0.1 g/m$^2$ to about 50 g/m$^2$ of the support area of the dry image forming material. A preferred amount of the organic silver salt oxidizing agent ranges from about 1 g/m$^2$ to about 10 g/m$^2$ of the support area of the dry image forming material.

The photosensitive silver compounds which can be employed as component (b) in this invention include silver chloride, silver bromide, silver iodide and any mixtures thereof. These photosensitive silver compounds may be prepared separately and then incorporated with the dry image forming materials of this invention. The amount of the photosensitive silver compound used typically ranges from about 0.1 percent by mole to about 50 percent by mole and preferably ranges from about 1 percent by mole to about 25 percent by mole based on the mole of the organic silver salt oxidizing agent.

The components capable of forming a photosensitive silver compound which can be employed as component (b) in this invention include any conventional halogen ion sources capable of forming a photosensitive silver compound by the reaction with the organic silver salt oxidizing agent (a).

Suitable examples of the halogen ion sources which can be employed in this invention include organic haloamides, halogen molecules, metal halides, quaternary ammonium salts, ionizable organic halogen compounds, nonmetallic halogen compounds and halogen-containing organometallic compounds.

Specific examples of the halogen ion sources include N-bromosuccinimide, N-chlorosuccinimide, N-iodosuccinimide, N-bromophthalimide, N-bromoacetamide, N-bromacetanilide, N-bromophthalazinone, 1-bromo-3,5,5-trimethyl-2,4-imidazolidinedione, 1,3-dibromo-5,5-dimethyl-2,4-imidazolidinedione, N,N-dibromobenzenesulfonamide, N-bromo-N-methylbenzenesulfonamide, 1,3-dibromo-4,4-dimethylhydantoin, potassium salt of dibromoisocyanuric acid, trichloroisocyanuric acid; iodine molecule; calcium iodide, barium iodide, rubidium iodide, cesium iodide, aluminum iodide, magnesium iodide, sodium iodide, potassium iodide, the bromides and the chlorides corresponding to the above described iodies; tetraethylammonium salts, benzyltrimethylammonium salts or phenyltrimethylammonium salts of hydroiodic acid, hydrobromic acid and hydrochloric acid; triphenylmethyl iodide, phenacyl bromide; triphenylphosphine diiodide, triphenylphosphine dibromide, triphenylphosphite diiodide, triphenylphosphite dibromide; titanocene dichloride, zirconocene dichloride, dimethylsilyl dichloride, trimethylsilyl chloride, triphenylgermanium bromide and any mixtures thereof.

The amount of the halogen ion source used typically ranges from about 0.1 percent by mole to about 50 percent by mole and preferably from about 1 percent by mole to about 25 percent by mole based on the mole of the organic silver salt oxidizing agent.

When the dry image forming materials of this invention contain the organic halomides, they become non-photosensitive under normal light conditions. On the other hand, when the dry image forming materials contain the metal halide or the quaternary ammonium salt, the dry image forming materials become photosensitive under normal light conditions.

The reducing agents for silver ion which can be used as component (c) in this invention include sterically hindered phenols in which a sterically bulky group is bonded to the carbon atom adjacent to the carbon atom bonded to the hydroxyl group; substituted phenols; hydroquinones; hydroquinone ethers; and other reducing agents for conventional wet processing silver salt type photosensitive materials.

Specific examples of reducing agent for silver ion include 2,6-di-tert-butyl-4-methylphenol, 2,2'-methylenebis(4-methyl-6-tert-butylphenol, 2,6-methylenebis(2-hydroxy-3-tert-butyl-5-methylphenyl)4-methylphenol, 2,2'-methylenebis(4-ethyl-6-tert-butylphenol), 2,4,4-trimethylpentylbis(2-hydroxy-3,5-dimethylphenyl)methane, 2,2'-methylenebis[4-methyl-6-(1-methylcyclohexyl)]phenol, 2,5-di-tert-butyl-4-methoxyphenol, p-phenylphenol, p-methoxyphenol, p-aminophenol, catechol, pyrogallol, resorcin, bisphenol A, 2,4-dihydroxybenzoic acid, hydroquinone, methylhydroquinone, chlorohydroquinone, bromohydroquinone, phenylhydroquinone, tert-butylhydroquinone, tert-octylhydroquinone, 2,5-dimethylhydroquinone, 2,6-dimethylhydroquinone, methoxyhydroquinone, hydroquinone monobenzyl ether, α-naphthol, β-naphthol, 1,3-dihydroxynaphthalene, 2,2'-dihydroxy-1,1'-binaphthyl, phenidone, methyl gallate, and any mixtures thereof.

A preferred reducing agent for silver ion can be chosen depending upon the organic silver salt oxidizing agent employed. For example, with an organic silver salt oxidizing agent such as silver behenate which is relatively hard to be reduced, a relatively strong reducing agent for silver ion such as a sterically hindered phenol including 2,2'-methylene-bis(4-ethyl-6-tert-butylphenol) is suitably chosen. On the other hand, with an organic silver salt oxidizing agent such as silver laurate which is relatively easy to be reduced, a relatively weak reducing agent for silver ion such as a substituted phenol including p-phenylphenol is suitably chosen, and with an organic silver salt oxidizing agent such as silver salt of benztriazole which is very hard to be reduced, a strong reducing agent for silver ion such as ascorbic acid is suitably chosen.

The amount of the reducing agent for silver ion may vary depending upon the organic silver salt oxidizing agent selected and the reducing agent for silver ion selected. In general, the amount of the reducing agent for silver ion used ranges from about 0.1 percent by weight to about 200 percent by weight based on the weight of the organic silver salt oxidizing agent. A preferred amount of the reducing agent for silver ion ranges from about 1 percent by weight to about 100 percent by weight.

α,α,α',α'-o-Tetrabromoxylene, α,α,α',α'-m-tetrabromoxylene, α,α,α',α'-p-tetrabromoxylene, 1,2-diiodoethane or tribromoacetic acid which can be employed as component (d) for preventing darkening of the background of images in this invention may be used alone or in the form of a mixture.

The amount of component (d) used typically ranges from about 1 percent by mole to about 100 percent by mole and preferably from about 1 to about 25 percent by mole based on the mole of the organic silver salt oxidizing agent.

In addition to the above-described components (a), (b), (c) and (d) of the dry image forming materials according to this invention, if necessary or if desired, the dry image forming materials of this invention may contain modifiers such as an anti-foggant, a film forming binder, a toner for silver images and a photosensitizer.

Suitable anti-foggants which can be used include mercury salts, palladium salts, benztriazoles, phenylmercaptotetrazoles, carboxylic acid anhydrides and any mixtures thereof. For example, when mercuric acetate is used as the anti-fogging agent in an amount as small as about 0.01 mole percent based on the mole of the organic silver salt oxidizing agent employed, the fogging of the dry image forming materials of this invention is remarkably reduced.

In many cases the film forming binder is required for shaping the dry image forming materials of this invention into a film. However, the organic silver salt oxidizing agent and/or the reducing agent act as the film forming binder, use of a film forming binder can be omitted.

Exemplary film forming binders which can be used in this invention include polyvinyl acetates, vinyl chloride-vinyl acetate copolymers, polyvinyl chlorides, polyvinyl butyrals, polymethyl methacrylates, cellulose acetates, cellulose acetate propionates, cellulose acetate butyrates, polyvinyl alcohols, polyvinyl pyrrolidones, gelatin, polystyrenes and any mixtures thereof. The film forming binder can be used generally in such an amount that the weight ratio of the film forming binder to the organic silver salt oxidizing agent ranges from about 0.1 to about 10.

Exemplary toners for silver images which can be used in this invention include phthalazinone, benzoxazidinedione, cyclic imides such as succinimide, quinazolinone, 2-pyrazoline-5-one, zinc acetate, cadmium acetate and any mixtures thereof. The amount of the toner for silver image typically ranges from about 0.01 mole to about 1 mole per mole of the organic silver salt oxidizing agent.

Suitable photosensitizers include amides such as 1-methyl-2-pyrrolidinone, 1-methylpiperidone, N,N-dimethylnicotinamide and N-acetylmorpholine and the amount of the photosensitizers used typically ranges from about 0.01 percent by mole to about 5 percent by mole based on the mole of the organic silver salt oxidizing agent.

For example, a dry image forming material of this invention may be prepared by dispersing an organic silver salt oxidizing agent prepared separately into a binder solution or a binder emulsion by a sand grinder, a mixer or a ball mill, mixing other components of this invention and, if necessary or if desired, other additives with the resulting emulsion to give a composition, coating the composition thus prepared on a support by a conventional method to form a layer of the dry image forming material and drying the layer of the dry image forming material. Exemplary supports which can be used in this invention include plastic films such as cellulose acetate films, polyester films, polyamide films, polyimide films, polyvinyl acetal films, polystyrene films, polyethylene films and polycarbonate films; glass plates; papers such as photographic base paper, coated paper, art paper, barite paper, waterproof paper and ordinary paper; and metal plates such as aluminum plates. The thickness of the layer of the dry image forming material dried typically ranges from about 1μ to about 1000μ. A preferred thickness of the layer of the dry image forming material dried ranges from about 3μ to 20μ. Also, the components of the composition of the dry image forming material may be coated on a support in a plurality of layers in any combinations.

Of the dry image forming materials of this invention, the dry image forming materials which are non-photosensitive under normal light conditions can be rendered photosensitive by the preliminary heating prior to the imagewise exposure to light.

The temperature of the preliminary heating which can be employed in this invention typically ranges from about 90° C. to about 200° C. and the period of time of the preliminary heating varies depending upon the temperature of the preliminary heating employed and becomes shorter with increased temperatures. In general, the period of time of preliminary heating ranges from about 1 second to about 60 seconds. Then, the dry image forming materials are subjected to the imagewise exposure to light and subsequently to the heat development, resulting in visible images.

Exemplary light sources which can be employed in the imagewise exposure to light include tungsten lamps, fluorescent lamps, xenon lamps, mercury lamps, iodine lamps and CRT light sources. Exemplary methods of the imagewise exposure to light include photographing with a camera, projective exposure and contact exposure by placing a manuscript on the image forming material. The period of time of the imagewise exposure to light varies depending upon the light source selected and typically ranges from about one hundredth of second to about 10 seconds.

The temperature of the heat development which can be used typically ranges from about 90° C. to about 200° C. and the period of time of the heat development varies depending upon the temperature of the heat development selected and typically ranges from about 1 second to about 60 seconds. When the preliminary heating and the heat development are conducted at the same temperature, the period of time of the heat development is generally longer than that of the preliminary heating. The preliminary heating and the heat development may be conducted using a hot plate, a hot roll, hot air, far infrared rays and high frequency induction heating.

The present invention will now be illustrated in more detail by the following non-limiting examples.

EXAMPLE 1

To 20 parts by weight of a mixed liquid of methyl ethyl ketone and toluene in a weight ratio of 2 to 1 were added 4 parts by weight of silver behenate, and the mixture was ball-milled for about 24 hours to give a uniform silver behenate suspension.

Then, an emulsion having Composition I as set forth below was prepared by mixing each of the ingredients of Composition I in the order described therein with stirring and coated on a polyester film as the first layer, and then dried in a dark room.

| Composition I | |
|---|---|
| Silver behenate suspension | 12.0 g |
| Polyvinyl butyral | 3.0 g |
| Methyl ethyl ketone | 12.0 g |
| Mercuric acetate | 0.05 g |
| α,α,α',α'-o-Tetrabromoxylene | 0.24 g |

-continued

| Composition I | |
|---|---|
| Tetraethylammonium bromide | 0.05 g |

Then, another emulsion having Composition II as set forth below was prepared and coated on the first layer as the second layer, and then dried in a dark room.

| Composition II | |
|---|---|
| Cellulose acetate | 1.2 g |
| Acetone | 16.3 g |
| Phthalazinone | 0.28 g |
| 2,2'-Methylenebis(6-tert-butyl-4-ethylphenol) | 0.70 g |

The image forming material thus prepared was exposed to light from a 500 watt xenon lamp through a mask film for one second and subsequently heated at 120° C. in a silicone oil bath for 5 seconds to develop a negative image.

The maximum optical density and the minimum optical density of the image formed are shown in Table I.

Further, the image thus obtained was exposed to light in a xenon fadeometer ("Fadeometer XF-1," manufactured by Suga Shikenki Co., Ltd.) for 2 hours to test its image stability. The maximum optical density and the minimum optical density of the image after the image stability test are also shown in Table I below.

Further, the same procedures of preparing the image as described above were repeated except that the α,α-,α',α'-o-tetrabromoxylene was omitted from the first layer. The maximum optical density and the minimum optical density of the image thus formed as well as those of the image after the same image stability test as described above are also shown in Table I.

TABLE I

| | Optical Density of Image | | | |
|---|---|---|---|---|
| | After Heat Development | | After Image Stability Test | |
| | Maximum | Minimum | Maximum | Minimum |
| α,α,α',α'-o-Tetrabromoxylene | 1.46 | 0.05 | 1.25 | 0.04 |
| None | 1.32 | 0.08 | 1.22 | 0.22 |

EXAMPLE 2

To 20 parts by weight of a mixed liquid of methyl ethyl ketone and toluene in a weight ratio of 2 to 1 were added 4 parts by weight of silver stearate, and the mixture was ball-milled for about 24 hours to give a uniform silver stearate suspension.

An emulsion having Composition III as set forth below was prepared by mixing each of the ingredients of Composition III in the order described therein with stirring, and coated on a polyester film as the first layer, and then dried in a light room.

| Composition III | |
|---|---|
| Silver stearate suspension | 12.0 g |
| Polyvinyl butyral | 3.0 g |
| Methyl ethyl ketone | 12.0 g |
| Mercuric acetate | 0.05 g |
| α,α,α',α'-Tetrabromoxylene as shown in TABLE II | 0.24 g |

-continued

| Composition III | |
|---|---|
| N-bromosuccinimide | 0.10 g |

Then, another emulsion having Composition IV as set forth below was prepared and coated on the first layer as the second layer, and then dried in a light room.

| Composition IV | |
|---|---|
| Polymethyl methacrylate | 1.2 g |
| Methyl ethyl ketone | 16.3 g |
| Phthalazinone | 0.28 g |
| 2,6-Methylenebis(2-hydroxy-3-tert-butyl-5-methylphenyl)-4-methylphenol | 0.7 g |

Each of the image forming materials thus obtained was preliminarily heated at 100° C. in a silicone oil bath for 5 seconds and exposed to light from a 500 watt xenon lamp through a mask film for 1 second, and subsequently heated at 120° C. for 10 seconds to develop a negative image.

The maximum optical density and the minimum optical density of the images thus formed are shown in Table II.

Further, each of the images formed was subjected to its image stability test by two methods. That is, one was the same image stability test as described in Example 1 and the other was that the image was kept under an illumination intensity of 500 luxes at a temperature of 50° C. at a relative humidity of 90% for 24 hours.

The maximum optical density and the minimum optical density of the image after the two image stability tests are also shown in Table II.

Further, the same procedures of preparing the image as described above were repeated except that the α,α-,α',α'-tetrabromoxylene was omitted from the first layer. Also, the same procedures of preparing the image as described above were repeated except that 0.24 g of 1,2,3,4-tetrabromobutane was used instead of the α,α-,α',α'-tetrabromoxylene.

The maximum optical density and the minimum optical density of the images thus obtained and those of the images after the same two image stability tests as described above are also shown in Table II.

Then, an emulsion having Composition V as set forth below was prepared by mixing each of the ingredients of Composition V in the order described therein with stirring, coated on an art paper and then dried in a dark room.

| Composition V | |
|---|---|
| Benztriazole silver salt suspension | 12.0 g |
| Polyvinyl butyral | 3.0 g |
| Methyl ethyl ketone | 12.0 g |
| Mercuric acetate | 0.05 g |
| α,α,α',α'-o-Tetrabromoxylene | 0.24 g |
| Calcium bromide | 0.10 g |
| Phthalimide | 0.5 g |
| t-Butylhydroquinone | 0.7 g |

The dry image forming material thus formed was exposed to light from a 300 watt tungsten lamp through a mask film for one second and subsequently heated at 110° C. for 10 seconds using a hot roll to develop a fine negative image.

Further, all the procedures of preparing the image as described above were repeated except that the α,α,α'-,α'-o-tetrabromoxylene was omitted.

The two images thus obtained were stored for one month in room light. The background of the image with the α,α,α',α'-o-tetrabromoxylene remained white as it was, while that without the α,α,α',α'-o-tetrabromoxylene was remarkably discolored to brown, and further the image became very unclear.

EXAMPLE 4

An emulsion having Composition VI as set forth below was prepared by mixing each of the ingredients of Composition VI in the order described therein with stirring and coated on a polyester film as the first layer, and then dried in a light room.

| Composition VI | |
|---|---|
| The same silver behenate suspension as in Example 1 | 12.0 g |
| Polyvinyl butyral | 3.0 g |
| Methyl ethyl ketone | 12.0 g |
| Mercuric acetate | 0.05 g |
| 1,2-Diiodoethane | 0.2 g |
| Triphenyl phosphite | 0.01 g |
| Iodine | 0.12 g |

TABLE II

| | Optical Density of Image | | | | | |
|---|---|---|---|---|---|---|
| | | | After Image Stability Test | | | |
| | After Heat Development | | A* | | B* | |
| α,α,α',α'-Tetrabromoxylene | Maximum | Minimum | Maximum | Minimum | Maximum | Minimum |
| α,α,α',α'-o-Tetrabromoxylene | 1.32 | 0.05 | 1.30 | 0.04 | 1.35 | 0.07 |
| α,α,α',α'-m-Tetrabromoxylene | 1.29 | 0.05 | 1.27 | 0.05 | 1.30 | 0.08 |
| α,α,α',α'-p-Tetrabromoxylene | 1.33 | 0.05 | 1.33 | 0.09 | 1.31 | 0.10 |
| None | 1.35 | 0.06 | 1.34 | 0.33 | 1.34 | 0.34 |
| 1,2,3,4-Tetrabromobutane | 1.38 | 0.06 | 1.35 | 0.15 | 1.30 | 0.21 |

Note:
A* : The same image stability test as in Example 1
B* : The image was kept under illumination intensity of 500 luxes at a temperature of 50° C. at a relative humidity of 90% for 24 hours.

EXAMPLE 3

To 20 parts by weight of methyl ethyl ketone were added 4 parts by weight of benztriazole silver salt, and the mixture was ball-milled for 24 hours to give a uniform benztriazole silver salt suspension.

Then, the same emulsion having Composition II as in Example 1 was coated on the first layer as the second layer, and then dried in a light room.

The image forming material thus prepared was preliminarily heated at 100° C. for 5 seconds in a dark room and exposed to light from a 500 watt xenon lamp through a mask film for one fourth of second, and subsequently heated at 130° C. for one second to develop a negative image.

The maximum optical density and the minimum optical density of the image formed as well as those of the image after the same image stability test as in Example 1 are shown in Table III below.

Further, the same procedures as described were repeated except that the 1,2-diiodoethane was omitted from the first layer. The maximum optical density and the minimum optical density of the image formed as well as those of the image after the same image stability test as in Example 1 are also shown in Table III below

TABLE III

| | Optical Density of Image | | | |
|---|---|---|---|---|
| | After Heat Development | | After Image Stability Test | |
| | Maximum | Minimum | Maximum | Minimum |
| 1,2-Diiodoethane | 1.88 | 0.06 | 1.90 | 0.07 |
| None | 1.76 | 0.08 | 1.72 | 0.31 |

EXAMPLE 5

The same procedures as described in Example 4 were repeated except that 0.3 g of tribromoacetic acid was used instead of the 1,2-diiodoethane and that 0.1 g of N-bromosuccinimide was used instead of the triphenyl phosphite and the iodine.

The maximum optical density and the minimum optical density of the image thus formed as well as those of the image after the same image stability test as in Example 1 are shown in Table IV below.

Further, the same procedures as described above were repeated except that the tribromoacetic acid was omitted.

The maximum optical density and the minimum optical density of the image thus formed as well as those of the image after the same image stability test as in Example 1 are also shown in Table IV below.

TABLE IV

| | Optical Density of Image | | | |
|---|---|---|---|---|
| | After Heat Development | | After Image Stability Test | |
| | Maximum | Minimum | Maximum | Minimum |
| Tribromoacetic acid | 1.06 | 0.07 | 0.98 | 0.06 |
| None | 1.15 | 0.08 | 1.19 | 0.46 |

While the invention has been described in detail and with reference to specific embodiments thereof, it will be apparent to one skilled in the art that various changes and modifications can be made therein without departing from the spirit and scope thereof.

What is claimed is:

1. A dry image forming material comprising:

(a) an organic silver salt oxidizing agent;

(b) a photosensitive silver halide or a component capable of forming a photosensitive silver halide by the reaction with the organic silver salt oxidizing agent (a);

(c) a reducing agent for silver ion; and (d) at least one compound selected from the group consisting of α,α,α′,α′-o-tetrabromoxylene, α,α,α′-,α′-m-tetrabromoxylene, α,α,α′,α′-p-tetrabromoxylene, 1,2-diiodoethane and tribromoacetic acid.

2. The dry image forming material as claimed in claim 1, wherein the compound (d) is α,α,α′,α′-o-tetrabromoxylene.

3. The dry image forming material as claimed in claim 1, wherein the compound (d) is α,α,α′,α′-m-tetrabromoxylene.

4. The dry image forming material as claimed in claim 1, wherein the amount of compound (d) ranges from about 1 percent by mole to about 100 percent by mole based on the mole of the organic silver salt oxidizing agent.

5. The dry image forming material as claimed in claim 4, wherein the amount of compound (d) ranges from about 1 percent by mole to about 25 percent by mole based on the mole of the organic silver salt oxidizing agent.

6. The dry image forming material as claimed in claim 1, wherein the organic silver salt oxidizing agent is a silver salt of a long chain aliphatic carboxylic acid having 12 to 24 carbon atoms.

* * * * *